United States Patent [19]

Lautenschläger et al.

[11] 4,376,324

[45] Mar. 15, 1983

[54] FURNITURE HINGE

[75] Inventors: Horst Lautenschläger, Reinheim; Gerhard Lautenschläger, Brensbach-Wersau; Karl Lautenschläger, Jr., Reinheim, all of Fed. Rep. of Germany

[73] Assignee: Mepla, Inc., High Point, N.C.

[21] Appl. No.: 210,614

[22] Filed: Nov. 26, 1980

[30] Foreign Application Priority Data

Sep. 26, 1980 [AT] Austria ..... 4841/80

[51] Int. Cl.[3] ..... E05D 7/04

[52] U.S. Cl. ..... 16/236; 16/249; 16/357; 16/382

[58] Field of Search ..... 16/129-131, 16/379, 357, 249, 236, 237, 247, 370, 360, 361, 382

[56] References Cited

U.S. PATENT DOCUMENTS 3,323,163 6/1967 Goodnow .

4,185,357 1/1980 Busse ..... 16/382

4,290,167 9/1981 Lautenschlager ..... 16/249

*Primary Examiner*—Werner H. Schroeder

*Assistant Examiner*—Andrew Falik

[57] ABSTRACT

An articulated hinge for pivotally connecting a door flap to the carcass of a piece of furniture which has spaced carcass walls and a frame facing the door and extending essentially at right angles to the carcass walls and confining a free door opening, while the door flap in closed position partially overlaps the frame. The hinge has a carcass-related part connected to the edge surface of the frame offset inwardly relative to the adjacent carcass wall, and a door-related part connected to the door flap and pivotally connected to the carcass-related part via a link mechanism. The door-related part is in the form of an insert cup with a connecting part fittingly inserted into a recess in the backside of the door flap, and a link carrier part which has a portion interlocking with the connecting part. The interlocking portion is displaceable at right angles with respect to the pivot axis of the hinge parallel to the backside of the door flap by a predetermined measure and can be connected on the door flap within this predetermined measure in random relative displacement positions.

12 Claims, 14 Drawing Figures

FIG.9
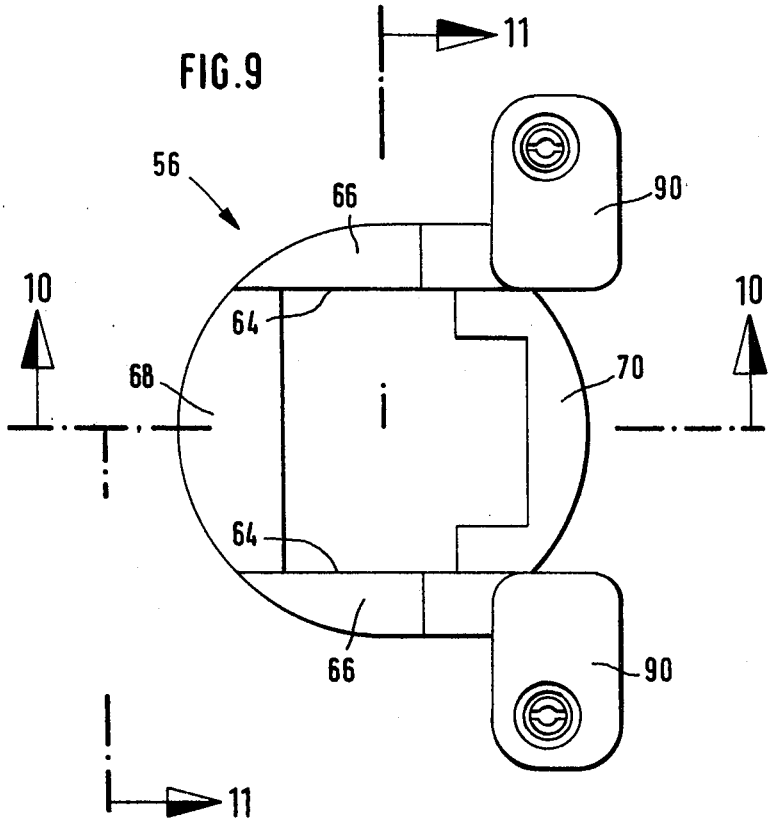
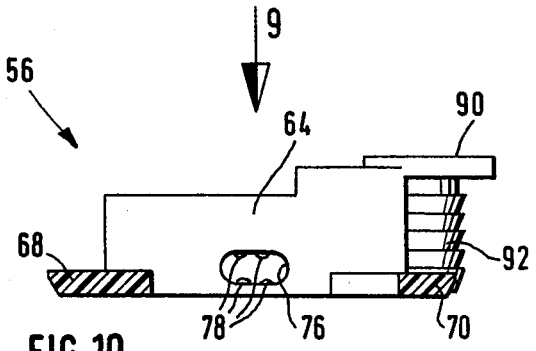
FIG.10

FIG.11
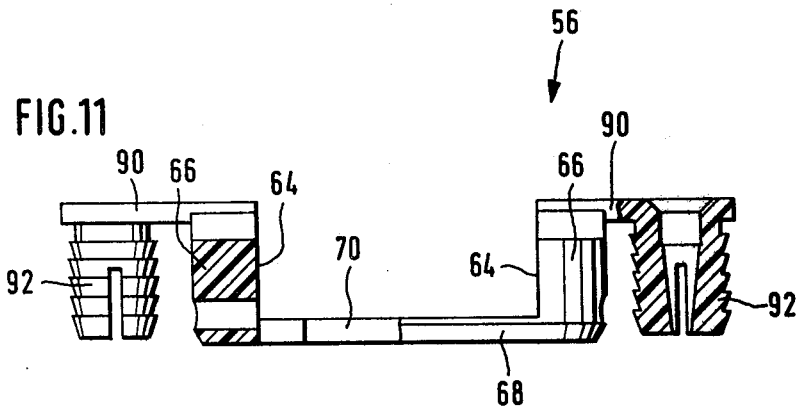
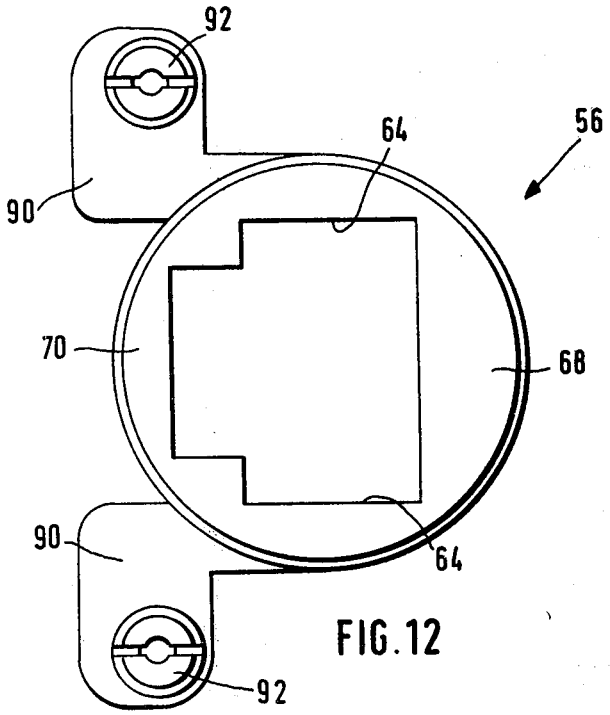
FIG.12

FURNITURE HINGE

BACKGROUND OF THE INVENTION

This invention relates to an articulated hinge for mounting a door leaf or flap at the carcass of a piece of furniture from whose carcass walls a frame protrudes at right angles the clear or unobstructed door opening of the piece of furniture. The frame is partially covered in the closed position of the door by the engaged door leaf. The hinge comprises a carcass-related part adapted to be connected to the edge surface of the frame confining the clear or unobstructed door opening and offset inwardly with respect to the supporting or carcass wall. The hinge furthermore comprises a door-related part adapted to be connected to the door or door-flap and pivotally connected to the carcass-related part by means of a link mechanism, with the door-related part being in the form of a cup adapted to be inserted into a fitting recess in the backside of the door flap and to be connected to the latter.

U.S. Pat. No. 4,207,652 discloses a mounting element which permits the pivotal connection of door-flaps by means of customary articulated hinges at the frame of pieces of furniture of the above-described type. In order to attach the mounting elements known from this patent, recesses have to be milled into the frame at the connecting point, which represents an undesirable additional work step.

In order to eliminate this work step a hinge has been proposed in U.S. Pat. No. 4,290,167, issued Sept. 22, 1981 to the assignee of this application. This hinge can be connected on the carcass side to the edge surface of the frame confining the clear or unobstructed door opening. The necessary adjustment of the overlap of the closed door flap on the front face of the frame is realized in this hinge by arranging an adjustment or displacement plate between the actual carcass-related part of the hinge and the edge surface of the frame. Complementary inclined ramp surfaces are provided on the surfaces of the adjustment plate and of a flange plate serving for connecting the carcass-related part to the frame, where these two surfaces face each other.

By varying the position of the adjustment plate and the flange plate relative to each other, i.e. by displacement of the adjustment plate relative to the fixed flange plate in the direction of the longitudinal extension of the frame surface the measure of overlap of the door on the frame front face can be varied, since the complementary ramp surfaces then slide up and down with respect to each other and the flange plate is lifted off the frame edge surface or approaches the same, respectively. The connection of the carcass-related part is effected by two connecting screws which pass through the flange plate and the adjustment plate and are screwed into the frame edge surface. When it is desired to change the amount of overlap of the door flap the connecting screws are loosened and after displacement of the adjustment plate tightened again. Since the flange plate of the carcass-related part is screwed directly to the frame by the connecting screws, i.e. since there is no separate mounting plate interposed as was the case with the customary hinges for frameless cabinets, upon frequent adjustment and readjustment of the door flap over a period of time, the threaded bores receiving the connecting screws may wear out and the screws may work themselves out of the frame so that the carcass-related part tends to become loose. The arrangement of the adjustment plate between the carcass-related part and the frame edge face necessarily interferes with the arrangement of the pivot points for the link mechanism on the carcass side and thereby prevents achieving a large amount of overlap.

It is, therefore, an object of the present invention to provide an articulated hinge of a piece of furniture with an inwardly protruding front frame, which can be connected directly to the frame without having to provide recesses in the frame while providing for the adjustment of the amount of overlap of the door flap at the frame without requiring loosening of the carcass-related part.

BRIEF SUMMARY OF THE INVENTION

The above-mentioned problem has been solved, starting from a hinge of the above-mentioned type, by making the insert cup in two parts, a connecting part fittingly inserted into the recess in the door flap or leaf, and a link carrier part at least partially interlocking with the connecting part. The portion of the link carrier part interlocked with the connecting part is displaceable relative to the connecting part at right angles to the pivot axis of the hinge and parallel to the backside of the door flap by a predetermined amount, and is within this predetermined displacement amount adapted to be connected in any desired position on the door flap.

According to a further feature of the invention, the link carrier may be provided with a flange resting on the backside of the door flap and covering the connecting part in all relative adjustment positions so that the connecting part is not visible at all when the hinge is completely mounted.

Advantageously, the flange of the link carrier in the area opposite the front edge of the door flap takes the form of an enlarged connecting flange in which there is provided at least one oblong hole extending in the direction of displacement of the link carrier relative to the connecting part for passage of the shaft of an associated connecting screw.

The connecting flange advantageously has a shallow recess on its bottom side facing the backside of the door flap, which recess is engaged by a flat, flap-like extension of the connecting part, with this extension being smaller than the recess by the predetermined amount of displacement of the link carrier relative to the connecting part.

In the area below an oblong hole in the connecting flange of the link carrier, the flap-like extension may have a connecting stud protruding towards the door flap, which stud is inserted into a corresponding bore in the backside of the door flap and which holds the insert cup additionally at the door flap.

It is advantageous to design the connecting stud or studs as spreadable or extendable studs which may be enlarged in diameter by the threaded shaft of this inserted connecting screw in order to thus obtain an optimum load bearing hold of the insert cup in the recess of the door flap.

The connecting part is preferably made of synthetic material, for instance, by injection molding, with the extension or extensions as well as the spreadable connecting studs, if provided, being integrally molded thereto.

The link carrier by contrast is made of metal, preferably by pressure casting, such as zinc pressure casting.

The link mechanism of the hinge according to the present invention may be in the form of a cross-link mechanism, with cross-link arms pivotally interconnected in their central areas in the manner of a pair of scissors, with one end of the respective arm being connected to one of the carcass or door-related parts and its other end being pivotally connected indirectly to the other part by means of a lever. The cross-link arms and the lever indirectly coupling the one cross-link arm with the carcass-related part each are provided with two sidewalls or cheeks arranged parallel to and spaced from each other. An over-center mechanism for arresting the hinge in its closed position may be arranged in the space between the sidewalls or cheeks.

In a further development of the invention, the over-center mechanism may be equipped with a two-arm cam lever journalled on the carcass-related part, with the first lever arm facing the door-related part being pretensioned in the direction of an abutment at the carcass-related part, whereas the top side of the second lever arm facing away from the door-related part is designed as a cam surface. This cam surface cooperates with an actuating element arranged between the cheeks of the double-cheek lever, in all positions with the exception of the positions of the hinge in the immediate area of the closed position, such that the lever arm of the cam lever which faces the door-related part is held lifted off the carcass-related part against the pretension of the spring.

The lever arm pointing towards the door-related part is preferably so designed and arranged, that, upon approaching the closed position, it grasps over the bearing pin pivotally interconnecting the cross-link arms in the manner of a pair of scissors, in the closed position of the hinge. Preferably, on the bearing pin there is rotatably mounted a roller running on the bottom side of this lever arm which is in the form of a cam surface. The roller prior to releasing the other lever arm abuts the actuating element at the cam surface.

The actuating element cooperating with the cam surface of the cam lever facing away from the door-related part may simply be a transverse pin held with its ends in bores in the cheeks of the double-cheek lever.

The connection of the carcass-related part may preferably be effected by means of a connecting flange protruding on both sides in the direction of the longitudinal extension of the frame front edge. Each connecting flange is provided with an oblong hole extending in the direction of the longitudinal extension of the frame front edge on either side of the carcass-related part, through which oblong hole a threaded shaft of a connecting screw may pass. The oblong holes permit an adjustment as to height of the door-flap to be pivotally connected to the carcass-related part.

In order to guarantee a correctly aligned connection of the connecting flange with the frame and to relieve the connecting screws of transverse forces, it is recommended in addition, that the connecting flange be given approximately the width of the front edge of the frame and to provide it with low, flat extensions in the area of its front and rear margins, which in mounted position rest against the front and rear flat side respectively of the frame.

BRIEF DESCRIPTION OF THE DRAWINGS

The invention is illustrated, by way of example, in the attached drawings, in which:

FIG. 9 is a top view of the connecting part of the door-related part of the hinge, as seen in the direction of the arrow 9 in FIG. 10;

FIG. 10 is a section through the connecting part, as seen in the direction of the arrows 10—10 in FIG. 9;

FIG. 11 is a front view, partially in section, of the connecting part shown in FIGS. 9 and 10, as seen in the direction of the arrows 11—11 in FIG. 9; the connecting stud shown on the right-hand side of the drawing being shown in partial section;

FIG. 12 is a bottom view of the connecting part shown in FIGS. 9 to 11;

DETAILED DESCRIPTION OF A PREFERRED EMBODIMENT

Figure 1:
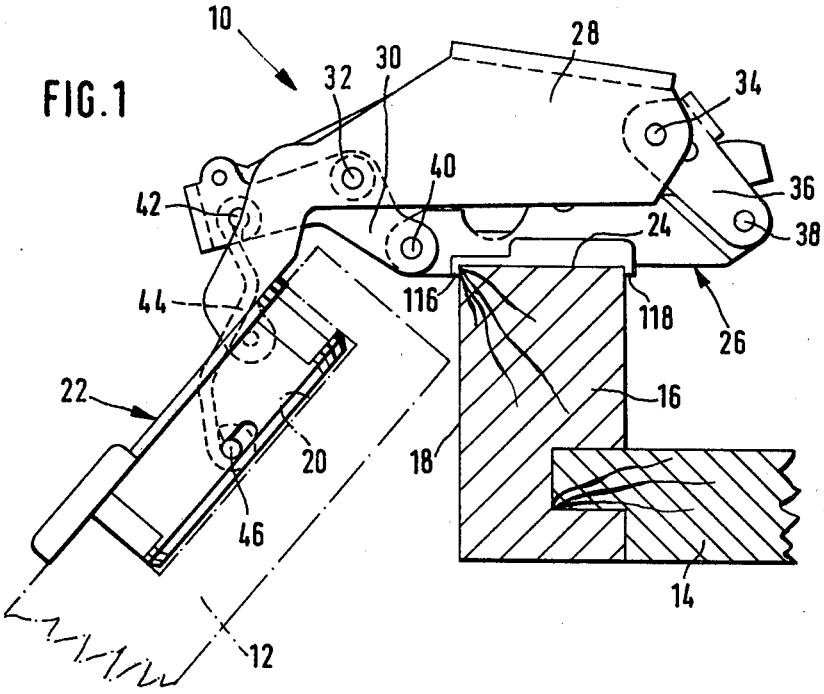
FIGS. 1 and 2 show the hinge according to the present invention in side view as attached to the frame of a cabinet carcass, with FIG. 1 showing the open and FIG. 2 the closed position of the hinge.
Figure 2:
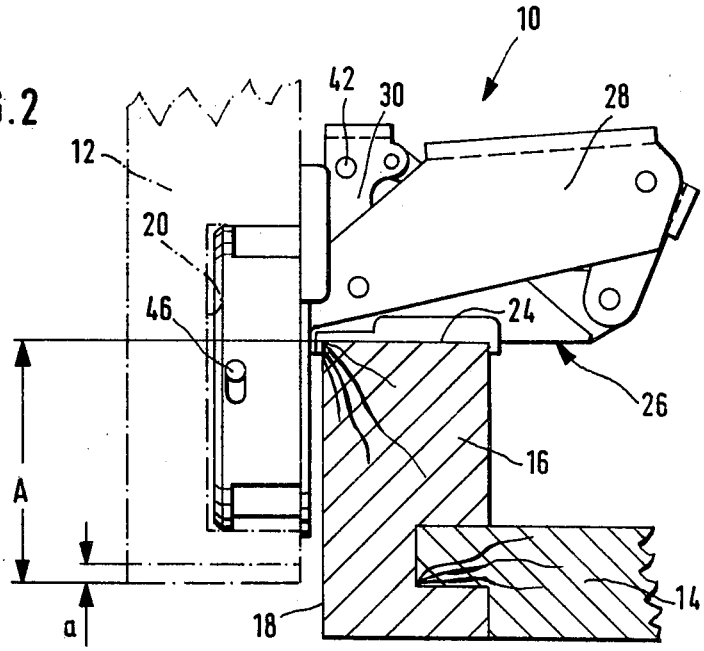
Figure 3:
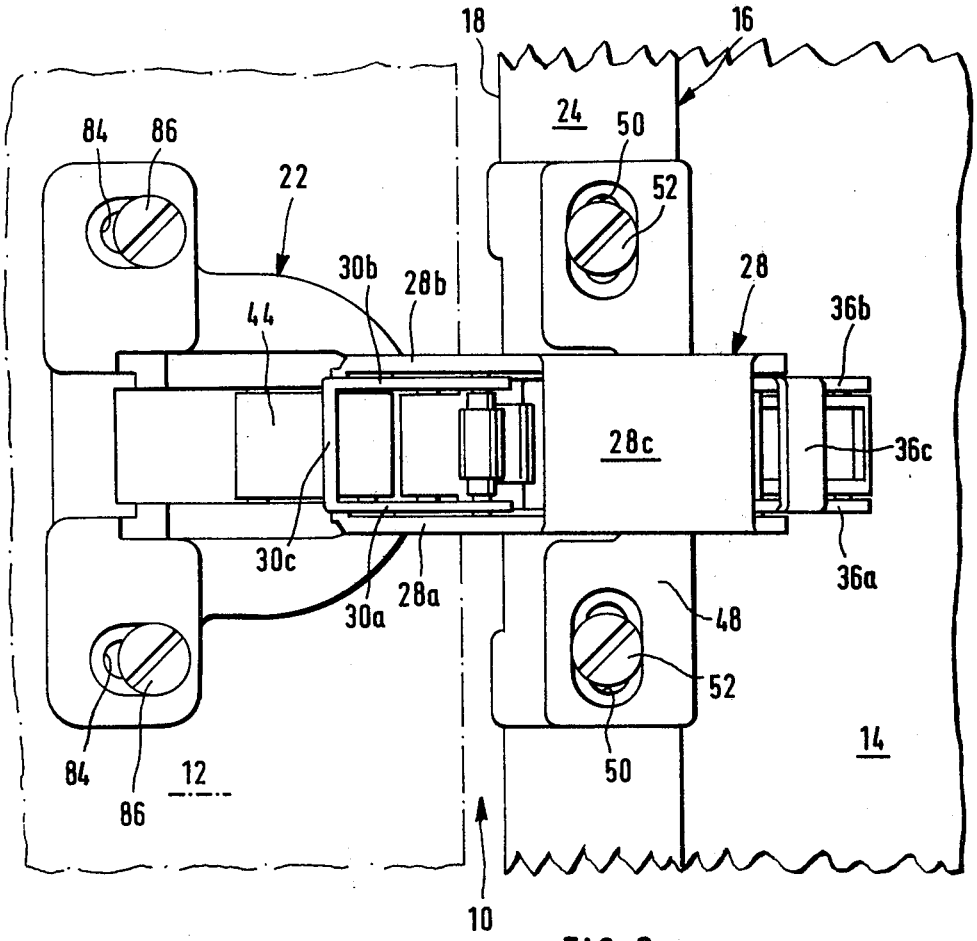
FIG. 3 is a top view of the hinge shown in FIGS. 1 and 2, in a position in which the door flap attached to the hinge is opened by about 90° compared to its closed position.

Referring now to the drawings in detail, FIGS. 1 to 3 show a hinge designated in its entirety with reference numeral 10. The hinge serves for pivotally connecting a door or door-flap 12 to a cabinet, the free door opening of which is confined by a frame 16 extending at right angles with respect to walls 14 of the cabinet. The door flap 12 in closed position (FIG. 2) covers the front face 18 of frame 16 by a pre-determined amount A. This amount A is adjustable within a range "a" (FIG. 2) relative to the frame for purposes of aligning or properly adjusting the door flap.

The hinge comprises a door-related part which in the embodiment shown takes the form of a cup or dish 22 inserted in a recess 20 of the door flap 12 and connectable thereto; a carcass-related part 26 adapted to be connected to the edge surface 24 of frame 16; and a cross-link mechanism pivotally interconnecting parts 22 and 26. It is of course to be understood that the invention is not limited to cross-link mechanisms but that other linking mechanisms could be used. The cross-link mechanism shown in FIGS. 1 and 2 comprises two cross-link arms 28, 30 which in their central area are pivotally interconnected by a bearing pin 32 in the manner of a pair of scissors. The cross-link arm 28 is pivotally journaled within and directly to the insert cup 22 at one end (the left end in FIGS. 1 and 2), whereas its other end adjacent the carcass is pivotally connected at 34 to a link 36 which in turn at 38 is pivotally journaled to that end of the carcass-related hinge part 26 which points into the interior of the cabinet. The second cross-link arm 30 in turn is directly connected to the carcass-related part 26 at 40 while its other end is pivotally coupled at 42 to one end of a link 44 the other end of which is journaled at 46 within the insert cup 22.

The basic structure of this cross-link mechanism in the above-described form is well-known. The dimensions of the cross-link arms and the arrangement of the pivot points have to be adjusted to the specific requirements in each case. The cross-link arms 28, 30 as well as the link 36 are sheet metal stamped or pressed parts, each having respectively two sidewalls or cheeks 28*a*, 28*b*; 30*a*, 30*b*; and 36*a*, 36*b* respectively, which are interconnected by means of cross-webs 28*c*, 30*c* and 36*c*, respectively. The carcass-related part is essentially located between the sidewalls or cheeks of the above-described members of the cross-link mechanism. However, as is clearly shown in FIG. 3, it is provided with a connecting flange 48 protruding from both sides and resting on the edge surface 24 of the frame. On each side of the carcass-related part an oblong hole 50 is provided in the flange 48, which extends in the direction of the longitudinal extension of the frame edge surface 24. Connecting screws 52 are screwed into the frame 16 through the oblong holes 50. The length of the oblong holes 50 predetermine the amount by which the variation in the connecting position of the carcass-related part 26 at frame 16 is possible.

Figure 4:
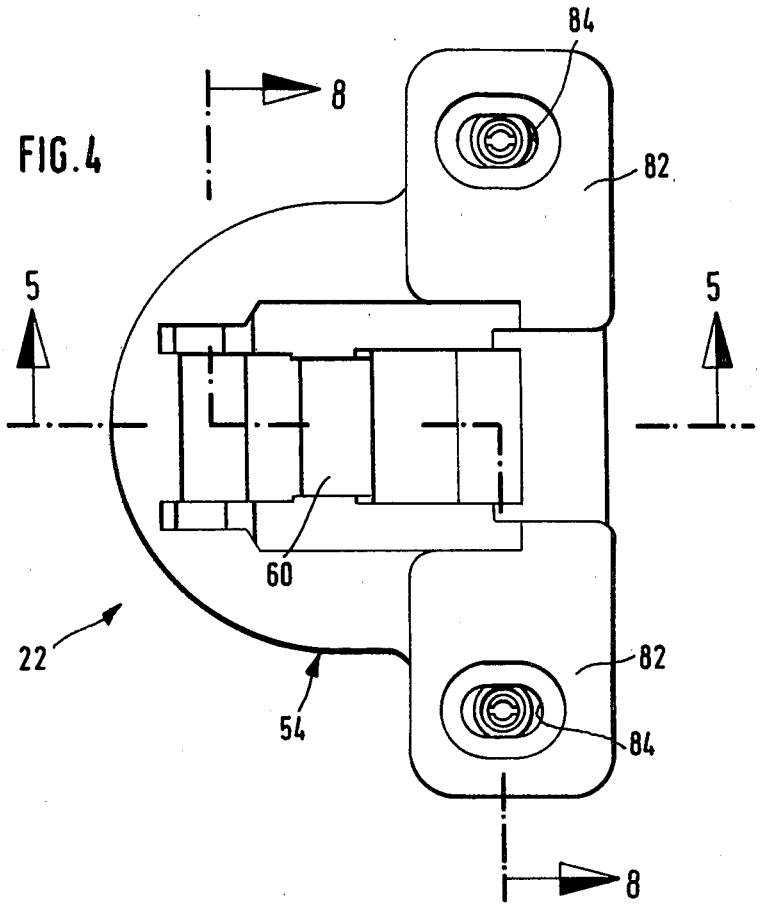
FIG. 4 is a top view of the door-related part of the hinge in a position turned by 180° compared to the position shown in FIG. 3.

The structure of the door-related part in the form of an insert cup 22 will now be described in connection with FIGS. 4 to 12 and 15. More specifically, FIGS. 4 to 6 show the cup in its entirety, and being composed of a link carrier 54 and a connecting part 56, while FIGS. 7 and 8 and FIGS. 9 to 12 show the link carrier 54 and the connecting part 56, respectively separately.

Link carrier 54 is preferably made from metal, for instance, by pressure casting. It comprises a guide piece 58 which is adapted to be inserted into the connecting part 56, which is made of synthetic material. Guide piece 58 is provided with a recess 60 in which are located, in the closed position of the hinge, the front sections of the cross-link arms 28, 30, the door-side front end of the carcass-related part 26, and a portion of the link 44. The guide piece 58 has lateral, plane confining surfaces 62 (FIG. 8) which are located between correspondingly plane inner-confining surfaces 64 of the connecting part 56 (FIG. 11). The connecting part practically consists of two parts 66 which are circular when viewed from the top (FIGS. 9 and 11) and which are integrally interconnected in their lower area by two transverse limbs or webs 68 and 70. The circular outer circumferential area of the parts 66 and the webs 68 and 70 are equal to the diameter of the recess 20 in door flap 12. Consequently, the connecting part 56 fits into the recess 20 and is therefore held nondisplaceably in the recess and parallel to the flat sides of the door flap. On the other hand, the guiding piece 58 is shorter in a direction parallel to the confining surfaces 62 and 64, respectively, than the diameter of the recess 20 so that the guide piece 58 and thereby the entire link carrier 54 is held between the form pieces 66 in such a way that it is displaceable in this direction by a certain amount.

Figure 5:
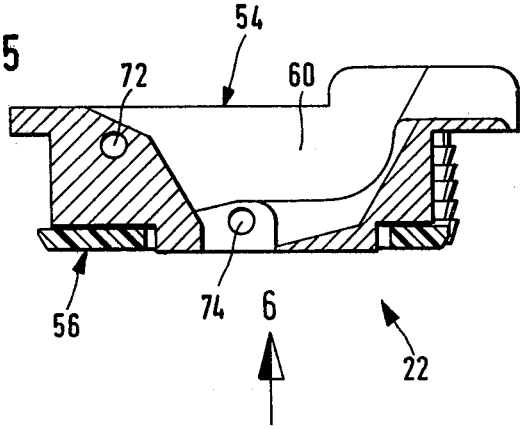
FIG. 5 is a section along the line 5—5 in FIG. 4.
Figure 6:
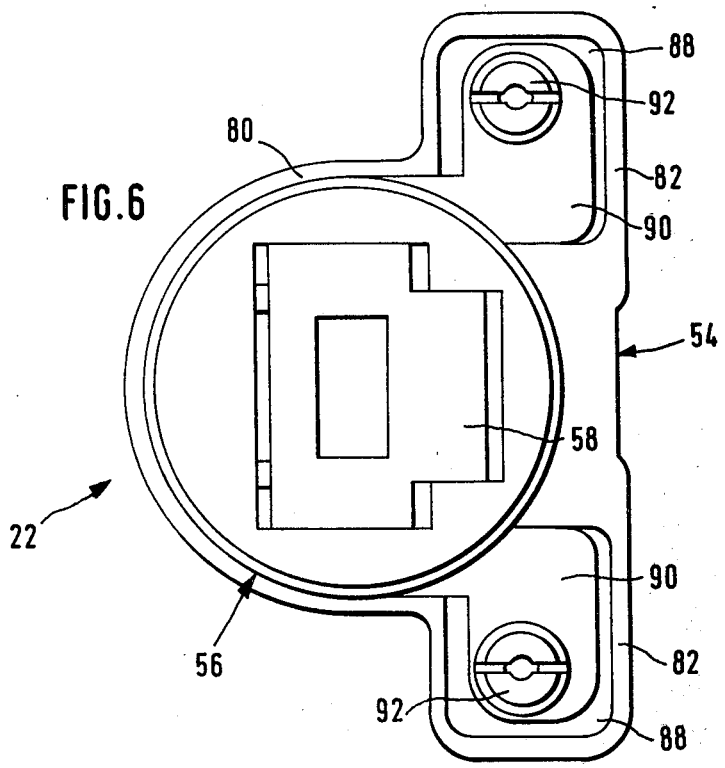
FIG. 6 is a bottom view of the door-related part of the hinge, as seen in the direction of the arrow 6 in FIG. 5.
Figure 7:
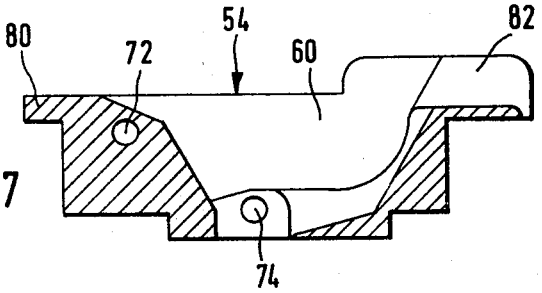
FIG. 7 is a section corresponding to that of FIG. 5 through the hinge carrier of the door-related hinge part shown in FIGS. 4 to 6.
Figure 8:
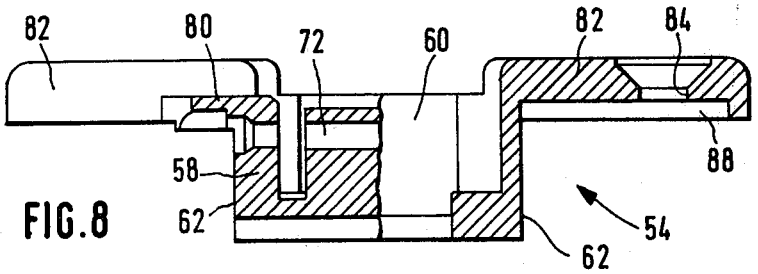
FIG. 8 is a cross-section through the link carrier according to FIG. 7, along a line indicated in FIG. 4 by arrows 8.

A bore 72 visible in FIGS. 5, 7 and 8 and provided in the link carrier serves for receiving a bearing pin which pivotally connects the front end of the cross-link arm 28 directly to the link carrier, whereas a bore 74 (FIGS. 5 and 7) serves for receiving a bearing pin journalling the link 44 on the door side in the link carrier. The bore 74 is associated with oblong holes 76 in form pieces 66 into which the bearing pin 46 for the link 44 protrudes. The bearing pin is long enough to protrude and prevents the link carrier from being pulled out of the connecting part. The guide piece 58 of link carrier 54 is, therefore, displaceable within the connecting part 56 by a predetermined amount determined by the length of the oblong holes 76. Inwardly extending protrusions 78 are provided on the lateral longitudinal surfaces of the oblong holes 76 (FIG. 10) and hold the bearing pin in a central displacement position. In view of the elasticity of the synthetic material of the connecting part, however, the bearing pin can be displaced beyond the protrusions 78 when applying even a small force.

The link carrier 54 has a flange 80 extending radially from the upper margin of the guiding piece 58 and covering the connecting part 56 in each displacement position. The radial flange 80 has two flange sections 82 in the area opposite the front edge of the door flap 12, which forms an enlarged connecting flange protruding on both sides and being arranged symmetrically to the longitudinal axis of the link carrier. Each flange section 82 is provided with an oblong hole 84 (FIGS. 3 and 4) extending in the direction of displacement of the link carrier relative to the connecting part. Connecting screws 86 (FIG. 3) pass through these oblong holes 84 into the door flap 12. Thus, the link carrier 54 and thereby the entire door-related part 22, is held in the desired adjustment position at the door flap 12.

The bottom side of the flange sections 82 facing the door flap 12 are provided with low recesses 88 (FIGS. 6 and 8) in which are located flat, flap-like extensions 90 (FIGS. 6, 9 and 12) radially protruding from the upper margin of the connecting piece 56. The extensions 90 are narrower in the direction of displacement than the recesses 88 so that they permit the displacement of the link carrier relative to the connecting part. Each of these flap-like extensions 90 is, in the area located below the corresponding oblong hole 84, provided with a connecting stud 92 which protrudes towards the door-flap 12 and which can be widened by the shaft of the respective connecting screw 86 like a spreadable stud or toggle. The connecting screws 86 are in the example shown not screwed directly into the material of the door-flap 12 but into the connecting studs 92 which in turn are pressed into related bores in the door-flap (not shown). It should be understood, however, that the connecting screws 86 may also be screwed directly into the material of the door-flap 12. By spreading the connecting studs 92, when screwing the connecting screws 86 in, it is possible to obtain a connection of the door-related part 22 at the door-flap which on the one hand can be subjected to high load and on the other hand can be loosened if desired and again reestablished. The flap-like extensions 90 and the connecting studs 92 are preferably integrally connected, for instance, by molding, to the connecting part 56.

Figure 13:
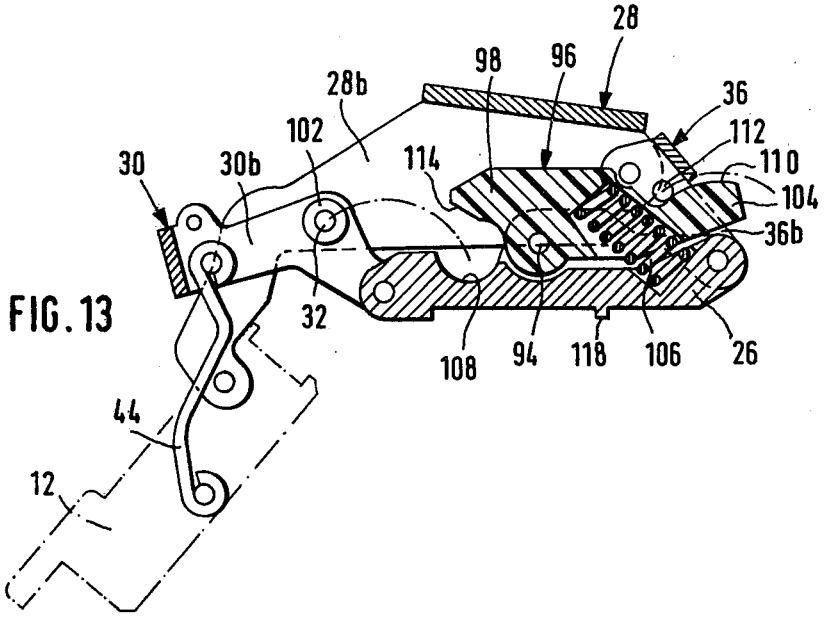
FIGS. 13 and 14 are each a diagrammatical section along the longitudinal central plane of the hinge according to the present invention, respectively showing it in its open and closed positions, and also showing an over-center mechanism for arresting the hinge in its closed position.
Figure 14:
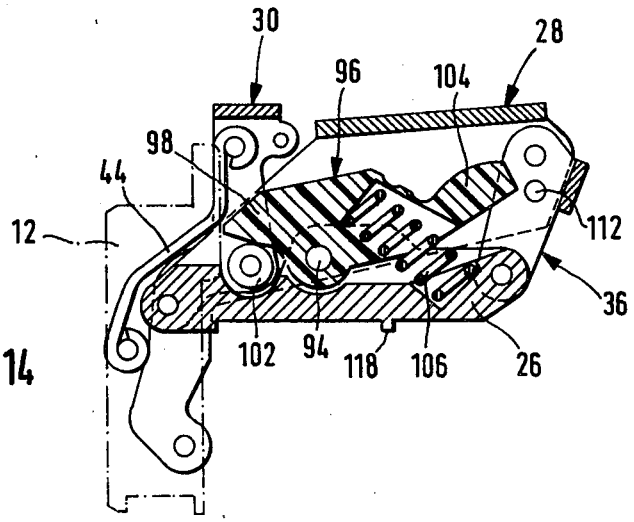
Figure 15:
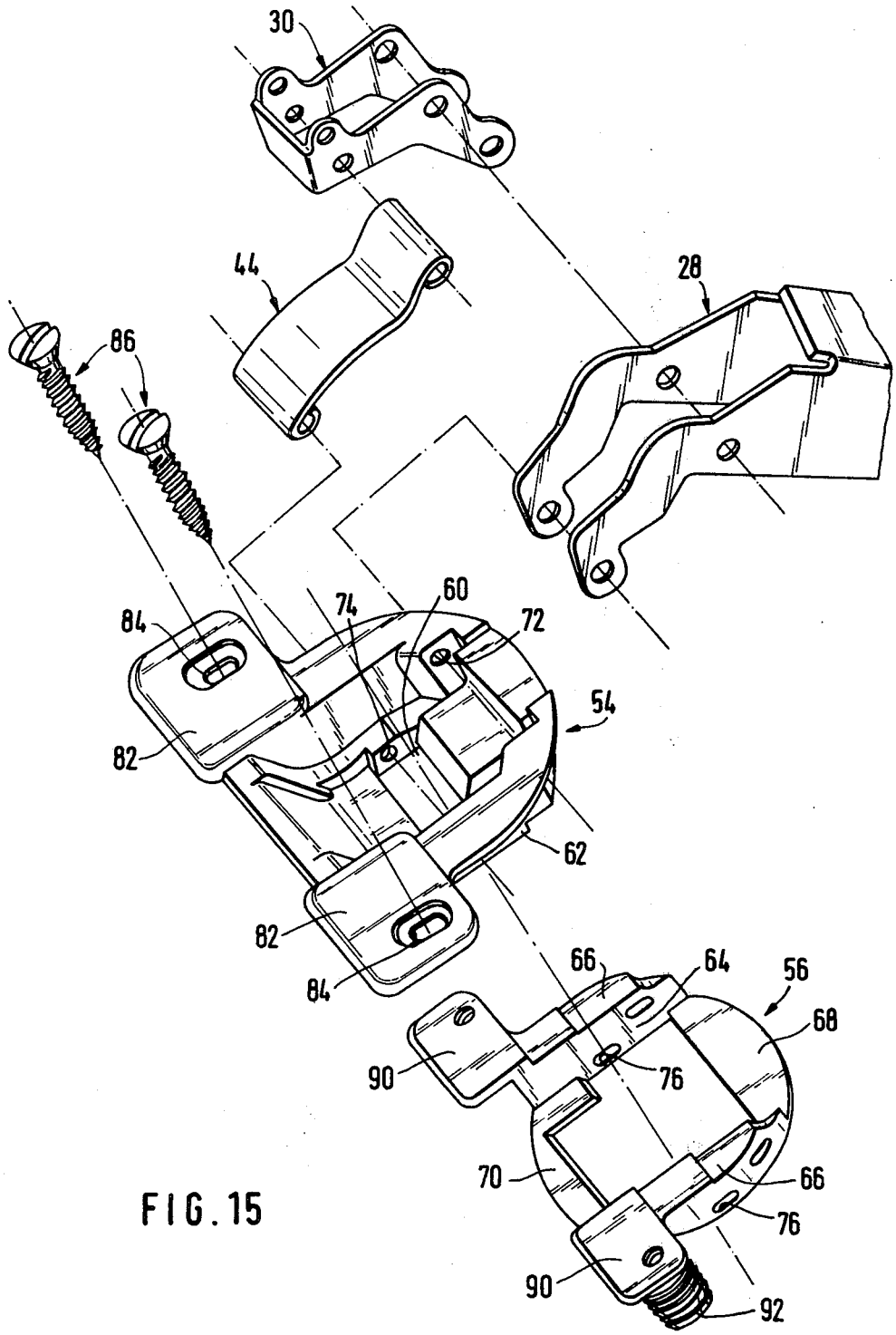
FIG. 15 is an exploded perspective view of parts of the hinge shown in FIGS. 4 to 12.

FIGS. 13 and 14 diagrammatically illustrate an over-center or snapper mechanism for arresting the hinge 10 in the closed position. It is arranged in the space between the sidewalls of the cross-link arms 28, 30 and the link 36 on the carcass-related part 26. The over-center mechanism essentially consists of a two-arm cam lever 96 which is pivotally journalled at 94 on the carcass-related part 26. Cam lever 96 has a first lever arm 98 which points to the door-related part 22 and which has at its bottom side a cam surface 114. Cam surface 114 cooperates with a roller 102 when approaching the closed position of the hinge (FIG. 14). Roller 102 is rotatably arranged on bearing pin 32 which pivotally interconnects the cross-link arms 28, 30 in the manner of a pair of scissors. For this purpose, the second lever arm 104 of lever 96 pointing towards the interior of the cabinet is pretensioned by a compression spring 106 supported at the carcass-related part 26 such that the first lever arm 98 is pretensioned in the direction of abutment on the topside of the carcass-related part. A depression 108 is provided in the topside of the carcass-related part 26, in which the roller 102 is located in the closed position of the hinge.

The top side of the second lever arm 104 has the form of a cam surface 110. A transverse pin 112 which extends between the sidewalls **36*a* and 36*b* of link 36, slides on surface 110 and thereby holds the first lever arm 98 lifted off the carcass-related part 26. The lever arm 96 can only tilt in counter-clockwise direction at the moment when the transverse pin 112 frees the cam surface 110. Depending on the kinematics of the cross-link mechanism and the length of the second lever arm 104, however, the release of cam surface 110 by transverse pin 112 takes place only shortly prior to reaching the closed position, when the roller 102 engages already the cam surface 114 at the bottom side of the lever arm 98. Upon release of the cam lever 96 by the transverse pin 112, therefore, the force of the spring 106 becomes effective between cam surface 114 and roller 102** with a force component acting in the closing direction.

It is, of course, to be understood that the invention is not limited to the specific embodiments of the hinge and over-center mechanism described above but encompasses all equivalents or modifications within the scope of the appended claims.

We claim:

1. An articulated hinge for pivotally connecting a door flap to the carcass of a piece of furniture which has spaced carcass walls and a frame, said frame facing the door and extending essentially at right angles to the carcass walls and confining a free door opening, said door flap in closed position partially overlapping said frame, said hinge comprising: a carcass-related part adapted to be connected to the edge surface of the frame offset inwardly relative to the adjacent carcass wall, and a door-related part pivotally connected to the carcass-related part via a link mechanism and adapted to be connected to the door flap, said door-related part being in the form of an insert cup adapted to be inserted fittingly into a recess in the backside of the door flap facing the piece of furniture, said insert cup comprising a connecting part adapted to be fittingly inserted into said recess and a link carrier part adapted to interlock at least partially with said connecting part, said link carrier part having a portion interlocking with said connecting part, said interlocking portion being displaceable at right angles with respect to the pivot axis of the hinge parallel to the backside of the door flap by a predetermined measure, said link carrier interlocking portion also being adapted to be connected on said door flap within said predetermined measure in random relative displacement positions.

2. An articulated hinge according to claim 1, in which said link carrier part comprises a flange for resting on the backside of the door flap and covering said connecting part in all said relative displacement positions.

3. An articulated hinge according to claim 2, in which said flange in the area lying opposite to the face edge of the door flap when mounted thereto is constructed as an enlarged connecting flange provided with at least one oblong hole extending in the direction of displacement of said link carrier part relative to said connecting part for the passage of the shaft of an associated connecting screw.

4. An articulated hinge according to claim 3, in which said connecting flange has a bottom side for facing the backside of the door flap, said bottom being provided with a relatively shallow recess receiving at least one flap-like extension of said connecting part, which extension is dimensioned smaller than said shallow recess by said predetermined displacement measure of said link carrier part relative to said connecting part.

5. An articulate hinge according to claim 4, in which said at least one flap-like extension comprises a connecting stud in the area respectively located below an oblong hole in said connecting flange of said hinge carrier part, said connecting stud protruding towards the door-flap when said hinge is mounted thereto.

6. An articulated hinge according to claim 4, in which said connecting part and said at least one flap-like extension are integrally molded from synthetic material.

7. An articulate hinge according to claim 5, in which said connecting stud is designed as an expandable stud adapted to be enlarged in diameter by the threaded shaft of a screwed-in connecting screw.

8. An articulated hinge according to claim 5, in which said connecting part, said at least one flap-like extension, and said connecting stud are integrally made from synthetic material.

9. An articulated hinge according to claim 1, in which said connecting part is made of synthetic material, by injection molding.

10. An articulated hinge according to claim 1, in which said link carrier part is made of metal.

11. An articulated hinge according to claim 10, in which said link carrier part is made from a metal pressure cast.

12. An articulated hinge according to claim 11, in which said metal cast is a zinc pressure cast.

* * * * *